US007367294B2

(12) United States Patent
Rozario et al.

(10) Patent No.: US 7,367,294 B2
(45) Date of Patent: May 6, 2008

(54) CYLINDER HEAD WITH INTEGRAL TUNED EXHAUST MANIFOLD

(75) Inventors: Frederick J. Rozario, Fenton, MI (US); Dominique T. Lester, Oxford, MI (US); Stephen R. Kornblum, Walled Lake, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 128 days.

(21) Appl. No.: 11/375,459

(22) Filed: Mar. 14, 2006

(65) Prior Publication Data

US 2007/0215074 A1 Sep. 20, 2007

(51) Int. Cl.
*F02F 1/36* (2006.01)

(52) U.S. Cl. ..... 123/41.82 R; 123/193.5

(58) Field of Classification Search ..... 123/41.82 R, 123/184.53, 193.5
See application file for complete search history.

(56) References Cited

U.S. PATENT DOCUMENTS 3,186,387 A * 6/1965 Kolbe et al. ..... 123/41.74
6,295,963 B1 * 10/2001 Kollock et al. ..... 123/193.5
6,513,506 B1 * 2/2003 Ito et al. ..... 123/568.13
7,051,685 B2 * 5/2006 Hayman et al. ..... 123/41.82 R

FOREIGN PATENT DOCUMENTS

EP 1006272 6/2000
JP 2709815 10/1997

* cited by examiner

*Primary Examiner*—Hieu T. Vo
*Assistant Examiner*—Katrina B. Harris

(57) ABSTRACT

Provided is a cylinder head including a head casting defining a plurality of exhaust ports. A tuned exhaust manifold is internally defined by the head casting. The tuned exhaust manifold includes a plurality of exhaust runners in communication with the plurality of exhaust ports and a collector volume in communication with the plurality of exhaust runners. Each of the plurality of exhaust ports and each of the plurality of exhaust runners are substantially oriented or directed toward the collector volume. Additionally, the head casting defines a main cooling jacket operable to cool the head casting. The head casting also defines an upper and lower cooling jacket disposed in heat exchange relation to the tuned exhaust manifold. The cylinder head casting may include integral spark plug tubes and cam drive case. Additionally, the cooling jackets may have a series coolant flow pattern or a parallel coolant flow pattern.

20 Claims, 5 Drawing Sheets

CYLINDER HEAD WITH INTEGRAL TUNED EXHAUST MANIFOLD

TECHNICAL FIELD

The present invention relates to internal combustion engines and more particularly to a cylinder head with an integral exhaust manifold.

BACKGROUND OF THE INVENTION

An internal combustion engine converts the chemical energy of the combustion fuel into mechanical energy to produce driving force. The internal combustion engine typically includes one or a plurality of reciprocating pistons that operate to drive a crankshaft. The crankshaft converts the reciprocal motion of the pistons to rotational motion. The pistons are slidably disposed within cylinders defined by a cylinder block or case. A cylinder head is removably mounted to the cylinder case and cooperates with the pistons and their respective bores to form variable volume combustion chambers within which the combustion of fuel occurs.

The cylinder head typically contains spark plugs, inlet valves, exhaust valves, and may contain one or a plurality of camshafts. Much of the valvetrain may be mounted with respect to the cylinder head. Generally, the cylinder head is an aluminum or iron casting that defines a portion of the variable volume combustion chambers, intake ports, and exhaust ports. The intake ports operate to communicate air or an air-fuel mixture to the variable volume combustion chamber, while the exhaust ports operate to exhaust products of combustion from the variable volume combustion chamber. An exhaust manifold is typically removably mounted to the cylinder head using conventional fastening techniques, such as threaded fasteners. Additionally, a gasket may be provided between the cylinder head and the exhaust manifold for sealing purposes. The exhaust manifold is typically formed from stainless steel or cast iron and includes runner portions in communication with each of the exhaust ports of the cylinder head. Additionally, the exhaust manifold typically includes a collector volume, in fluid communication with each of the exhaust runner portions, which operates to communicate the products of combustion to the downstream components of the vehicle exhaust system, such as catalytic converters and mufflers. The cylinder head and cylinder case define a series of passages or cooling jackets that facilitate coolant flow. Coolant is circulated through the cooling jackets to cool the cylinders and the general area above the combustion chambers.

Recently, engine manufacturers have designed cylinder heads wherein the exhaust manifold, i.e. the exhaust runners and collector volume are internally defined by the cylinder head casting to form an integral exhaust manifold. These designs typically include exhaust ports and exhaust runners that are configured in a generally orthogonal relation to the collector volume forming a "log style" exhaust manifold.

SUMMARY OF THE INVENTION

A cylinder head is provided having a head casting defining a plurality of exhaust ports. A tuned exhaust manifold is internally defined by the head casting and includes a plurality of exhaust runners in communication with the plurality of exhaust ports. The tuned exhaust manifold includes a collector volume in communication with the plurality of exhaust runners. Each of the plurality of exhaust ports and each of the plurality of exhaust runners are substantially oriented or directed toward the collector volume.

Additionally, the head casting may define a main cooling jacket and an upper and lower exhaust manifold cooling jacket in heat exchange relationship with the tuned exhaust manifold. The cooling jackets may be formed by one of a one piece, two piece, and three piece cooling jacket core. The main cooling jacket and the upper and lower exhaust manifold cooling jacket may have a series coolant flow pattern or a parallel coolant flow pattern. The cylinder head may further include at least one spark plug tube formed integrally with the cylinder head casting. Furthermore, the cylinder head may also include a cam drive case formed integrally with the cylinder head casting.

The above features and advantages and other features and advantages of the present invention are readily apparent from the following detailed description of the best modes for carrying out the invention when taken in connection with the accompanying drawings.

DESCRIPTION OF THE PREFERRED EMBODIMENT

Figure 1:
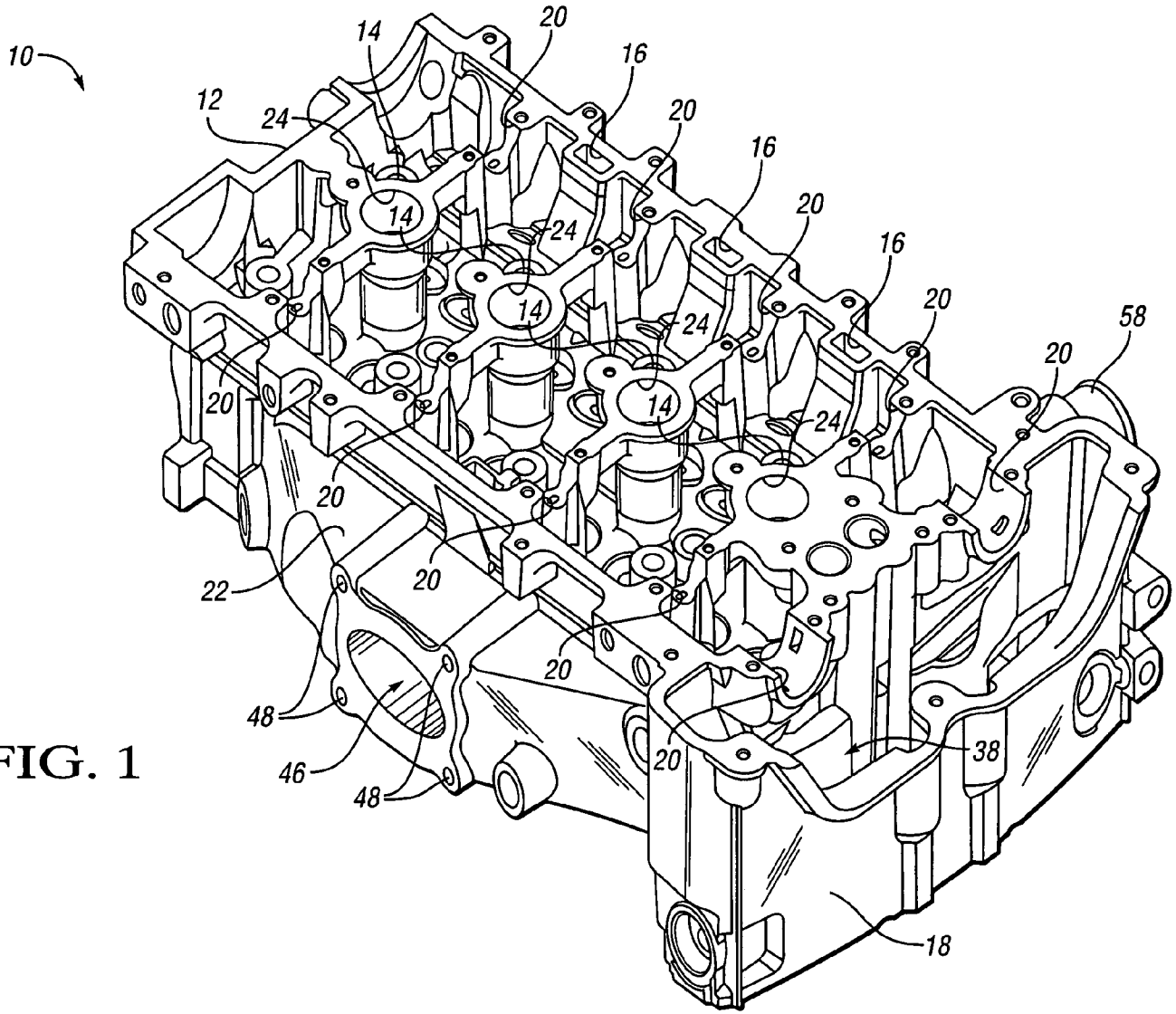
FIG. 1 is a perspective view of a cylinder head incorporating an integral tuned exhaust manifold consistent with the present invention.
Figure 2:
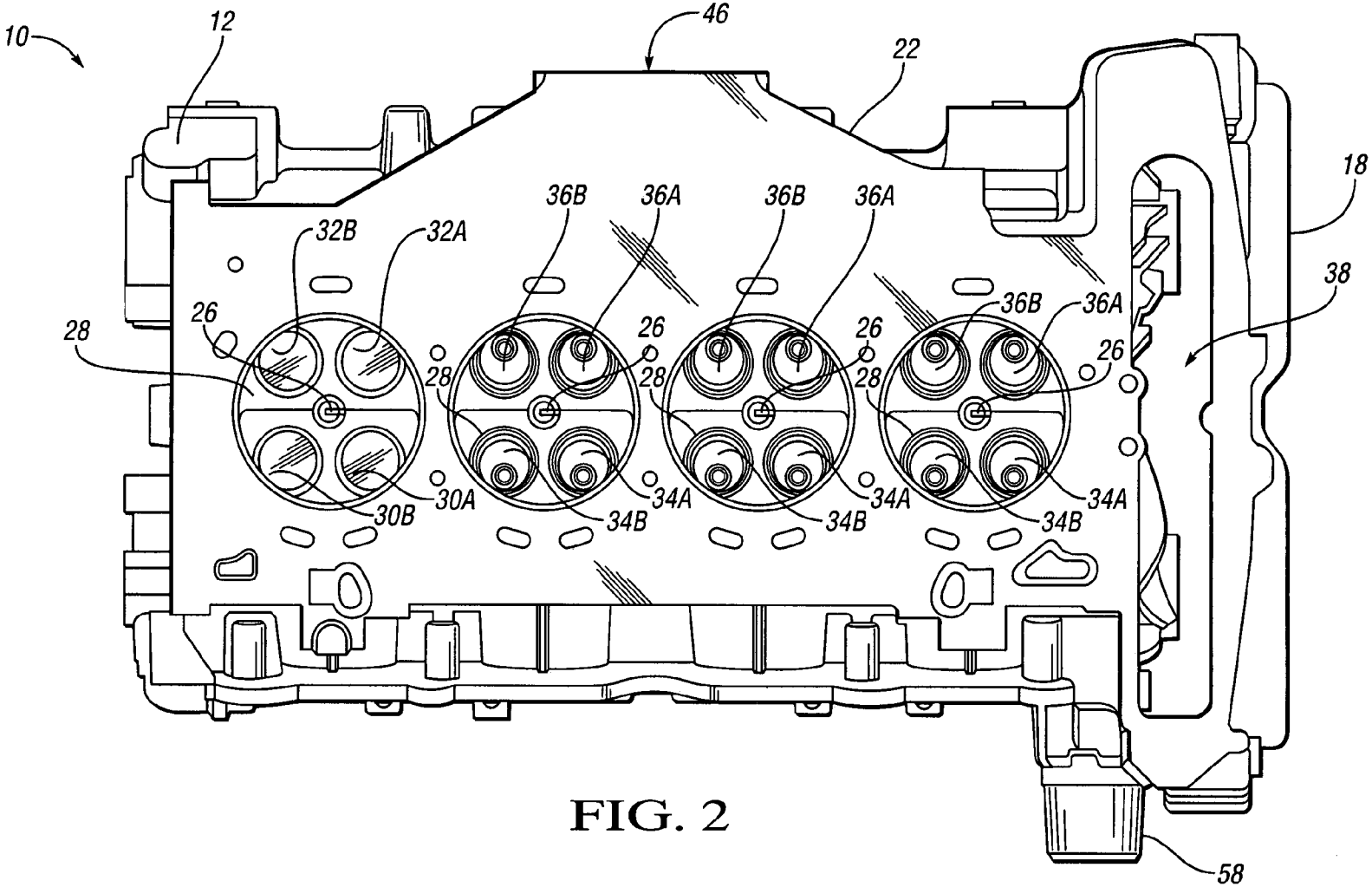
FIG. 2 is a bottom view of the cylinder head shown in FIG. 1.
Figure 3:
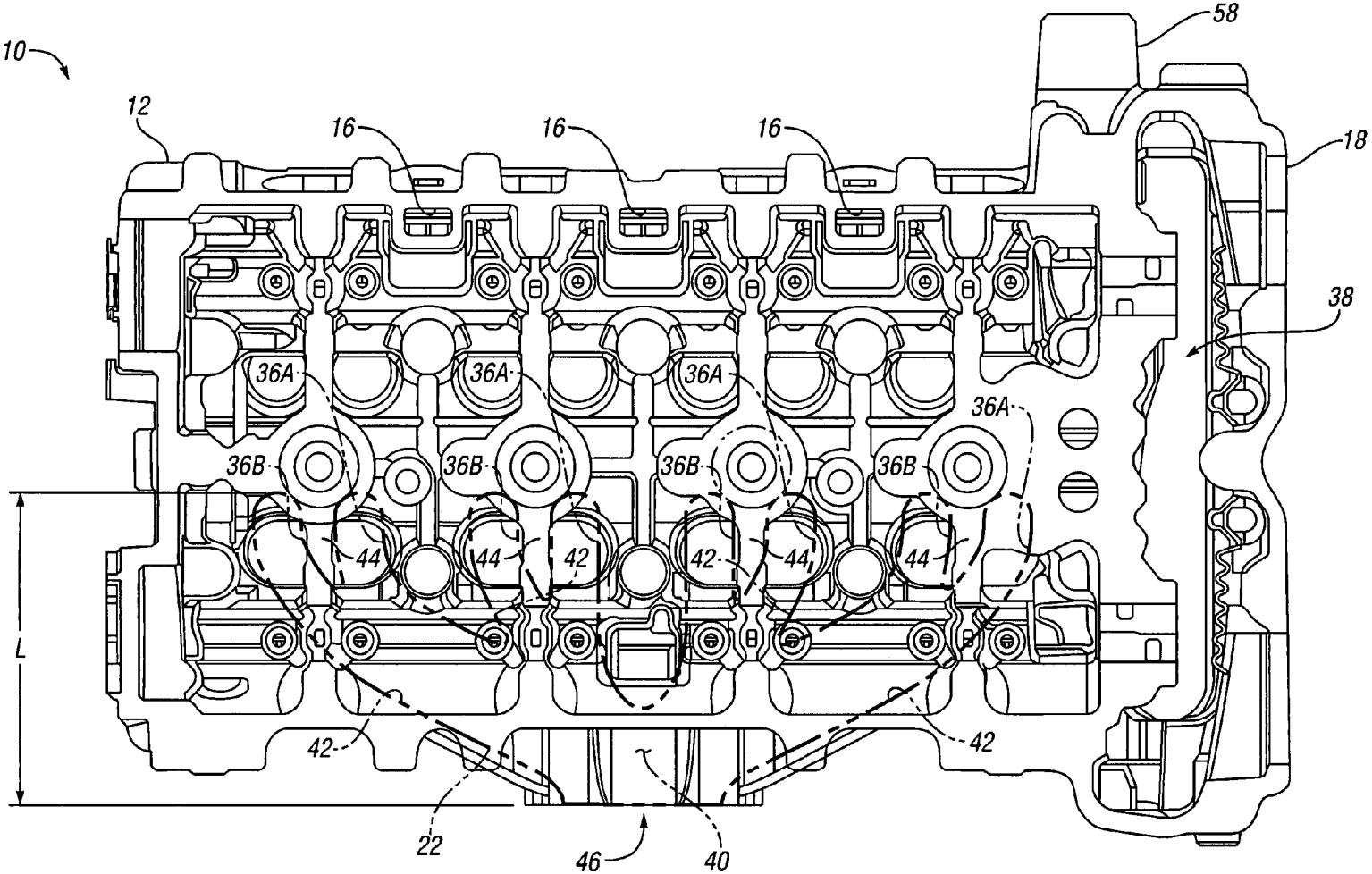
FIG. 3 is a top view of the cylinder head shown in FIGS. 1 and 2, illustrating the configuration of the integral tuned exhaust manifold.

Referring to the drawings wherein like reference numbers represent like components throughout the several figures, there is shown in FIGS. 1, 2, and 3 a cylinder head 10. The cylinder head 10 is sufficiently configured for demountable attachment to a cylinder case or block, not shown, which defines one or a plurality of cylinder bores each having a piston reciprocally movable therein. The cylinder head 10 shown in FIG. 1 is configured for use with an in-line four-cylinder engine. However, those skilled in the art will recognize that which is claimed may be used with various other engine configurations such as V-type engines. Additionally, the engine may include an alternate number of cylinder bores such as, for example, 3, 6, 8, 10, or 12. The cylinder head 10 includes a cylinder head casting 12. In the preferred embodiment, the cylinder head casting 12 includes a plurality of integral spark plug tubes 14, a plurality of integral crank case vent orifices 16, an integral cam drive case 18, and a plurality of camshaft bearing surfaces 20. Additionally, the cylinder head casting 12 includes an integral tuned exhaust manifold 22.

The integral spark plug tubes 14 each define a generally cylindrical bore 24 that is sufficiently configured to receive a spark plug 26, shown in FIG. 2, and locate the spark plug 26 within a respective combustion chamber 28, shown in FIG. 2. Each of the combustion chambers 28 is exposed to the combustion fuel and air within the engine during engine operation. The cylinder head casting 12, shown in FIGS. 1 and 2, are of a four valve per cylinder variety in that there are two intake valves 30A and 30B and two exhaust valves 32A and 32B for each of the respective combustion chambers 28. For purposes of discussion, only one combustion chamber 28 is shown in FIG. 2 to contain intake valves 30A and 30B and exhaust valves 32A and 32B. The intake valves 30A and 30B selectively open a respective intake port 34A and 34B, defined by the cylinder head casting 12, to the combustion chamber 28. By selectively opening the intake ports 34A and 34B to the combustion chamber 28, an air charge or fuel and air charge is introduced into the combustion chamber 28 for subsequent ignition by the spark plug 26. Additionally, the exhaust valves 32A and 32B selectively open the combustion chamber 28 to a respective exhaust port 36A and 36B, which are defined by the cylinder head casting 12. By selectively opening the combustion chamber 28 to the exhaust ports 36A and 36B, the products of combustion can be evacuated or exhausted from the combustion chamber 28. Those skilled in the art will recognize that other valve configurations may be used while remaining within the scope of that which is claimed such as, for example, two valve per cylinder engines, where one intake and one exhaust valve is provided for each combustion chamber.

The integral crank case vent orifices 16, shown in FIGS. 1 and 3, operate to maintain proper gas circulation within the engine to promote effective functionality of the crankcase ventilation system, not shown. The cylinder head casting 12, shown in FIG. 1 and 2, is configured as a dual overhead cam arrangement, such that a camshaft, not shown, is received by the camshaft bearing surfaces 20 to actuate the intake valves 30A and 30B. Similarly, another camshaft, not shown, is received by the camshaft bearing surfaces 20 to actuate the exhaust valves 32A and 32B. Additionally, the integral cam drive case 18 defines a passage 38 through which a cam drive mechanism, not shown, such as a belt or chain may pass.

Referring now to FIG. 3, there is shown a top view of the cylinder head 10 shown in FIGS. 1 and 2. The integral tuned exhaust manifold 22 is shown in phantom and is internally defined by the cylinder head casting 12. The integral tuned exhaust manifold 22 includes a collector volume 40 in downstream fluid communication with a plurality of exhaust runners 42. Each of the exhaust runners 42 are in downstream fluid communication with respective exhaust ports 36A and 36B. A divider or septum 44 separates the exhaust ports 36A and 36B. In accordance with the present invention, the exhaust ports 36A and 36B of the cylinder head casting 12 are generally angled or directed toward the collector volume 40. Additionally, the exhaust runners 42 of the cylinder head casting 12 are generally angled or directed toward the collector volume 40. By specifically targeting or positioning the exhaust ports 36A and 36B and the exhaust runners 42 toward the collector volume 40, the length of each exhaust port 36A and 36B and the respective exhaust runner 42 are nearly equal. Equal length or near equal length exhaust ports and exhaust runners are beneficial for engine tuning and performance since the exhaust gas pulses are more evenly sequenced. Through constructive interference between exhaust pulses, equal length exhaust ports and exhaust runners enable increased exhaust flow thereby increasing the peak power of the engine. Additionally, packaging requirements for the cylinder head 10 may be reduced since the length L, shown in FIG. 3, is reduced by angling or directing the exhaust ports 36A and 36B inward toward the collector volume 40 as compared to other integral exhaust manifolds, such as "log style" variations where the exhaust ports and exhaust runners are oriented generally orthogonally to the collector volume.

Referring to FIGS. 1 through 3, in operation, products of combustion will selectively flow into the exhaust ports 36A and 36B from the respective combustion chamber 28. These products of combustion are then communicated to the collector volume 40 via the exhaust runners 42. An exhaust outlet 46 is defined by the cylinder head casting 12, and operates to provide a passage through which the products of combustion contained within the collector volume 40 may exit the cylinder head 10. Preferably, the cylinder head casting 12 defines a plurality of threaded bores 48, shown in FIG. 1, spaced from the exhaust outlet 46 and sufficiently configured to receive a respective fastener, not shown, to effect attachment of the vehicle exhaust system to the cylinder head 10.

Figure 4:
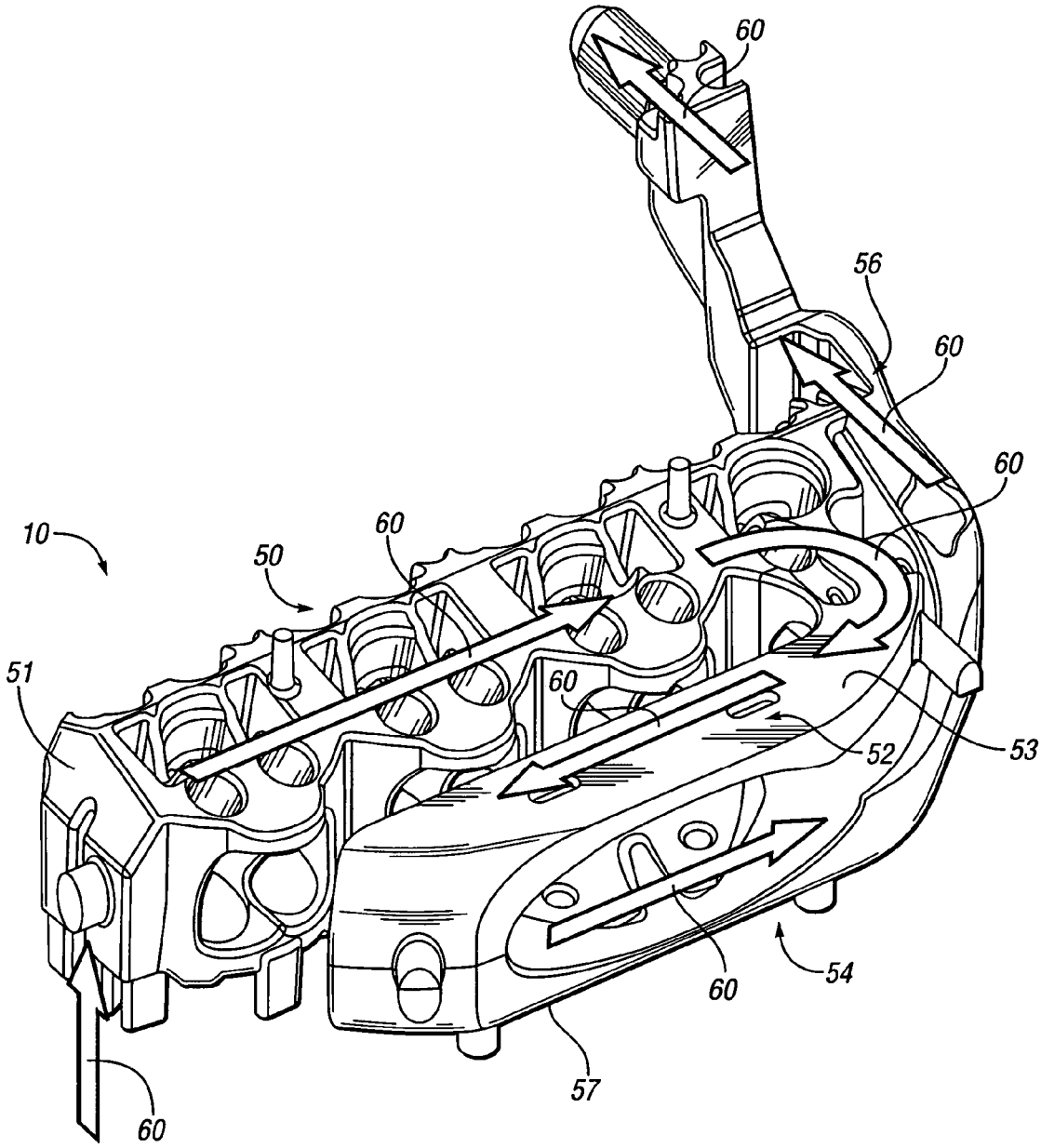
FIG. 4 is a perspective view of cooling jackets defined by the cylinder head shown in FIGS. 1 through 3, illustrating a series coolant flow pattern through the cylinder head for a three piece cooling jacket core design.

Referring now to FIG. 4, and with further reference to FIGS. 1 through 3, there is shown the internal cooling passages or jackets of the cylinder head casting 12 formed using a three piece cooling jacket core design. The cylinder head casting 12 defines a main cooling jacket 50 that operates to extract heat energy, generated by combustion of fuel and air within the combustion chambers 28, from the cylinder head 10. A first cooling jacket core member 51 forms the main cooling jacket 50 during the forming or casting operation of the cylinder head casting 12. The main cooling jacket 50 is in fluid communication with an upper exhaust manifold cooling jacket 52. A second cooling jacket core member 53 forms the upper exhaust manifold cooling jacket 52 during the casting of the cylinder head casting 12. The upper exhaust manifold cooling jacket 52 is in fluid communication with a lower exhaust manifold cooling jacket 54. Additionally, the lower exhaust manifold cooling jacket 54 is in fluid communication with a coolant outlet passage 56. The coolant outlet passage 56 is disposed between the main cooling jacket 50 and the integral cam drive case 18, such that the coolant outlet passage 56 traverses the cylinder head casting 12 from the lower exhaust manifold cooling jacket 54 to a coolant outlet fitting 58, shown in FIGS. 1 through 3. A third cooling jacket core member 57 forms lower exhaust manifold cooling jacket 54 and the coolant outlet passage 56 during the casting operation of the cylinder head casting 12.

In operation, the cylinder head 10 receives coolant, represented by arrow 60, from the cylinder block, not shown. The bulk of this coolant 60 is directed toward the rear, or side opposite the integral cam drive case 18, of the cylinder head 10. The coolant 60 flows through the main cooling jacket 50, thereby extracting heat energy from the cylinder head 10 and, more specifically, in the general region of the combustion chambers 28. As the coolant 60 moves toward the front of the cylinder head, i.e. toward the integral cam drive case 18, the coolant 60 is introduced to the upper exhaust manifold cooling jacket 52 where it extracts heat energy from the integral tuned exhaust manifold 22. The coolant 60 is then communicated to the lower exhaust manifold cooling jacket 54 where the coolant continues to extract heat energy form the integral tuned exhaust manifold 22. Subsequently the coolant 60 is introduced to the coolant outlet passage 56 where it traverses the cylinder head in a generally orthogonal orientation with respect to the main cooling jacket 50. The coolant 60 exits the cylinder head 10 through the coolant outlet fitting 58 where it is subsequently introduced to the cooling system of the vehicle. This type of coolant flow pattern is referred to as a series coolant flow pattern, wherein the coolant 60 must traverse the main cooling jacket 50 prior to being communicated to the upper exhaust manifold cooling jacket 52 for subsequent introduction to the lower exhaust manifold cooling jacket 54.

Figure 5:
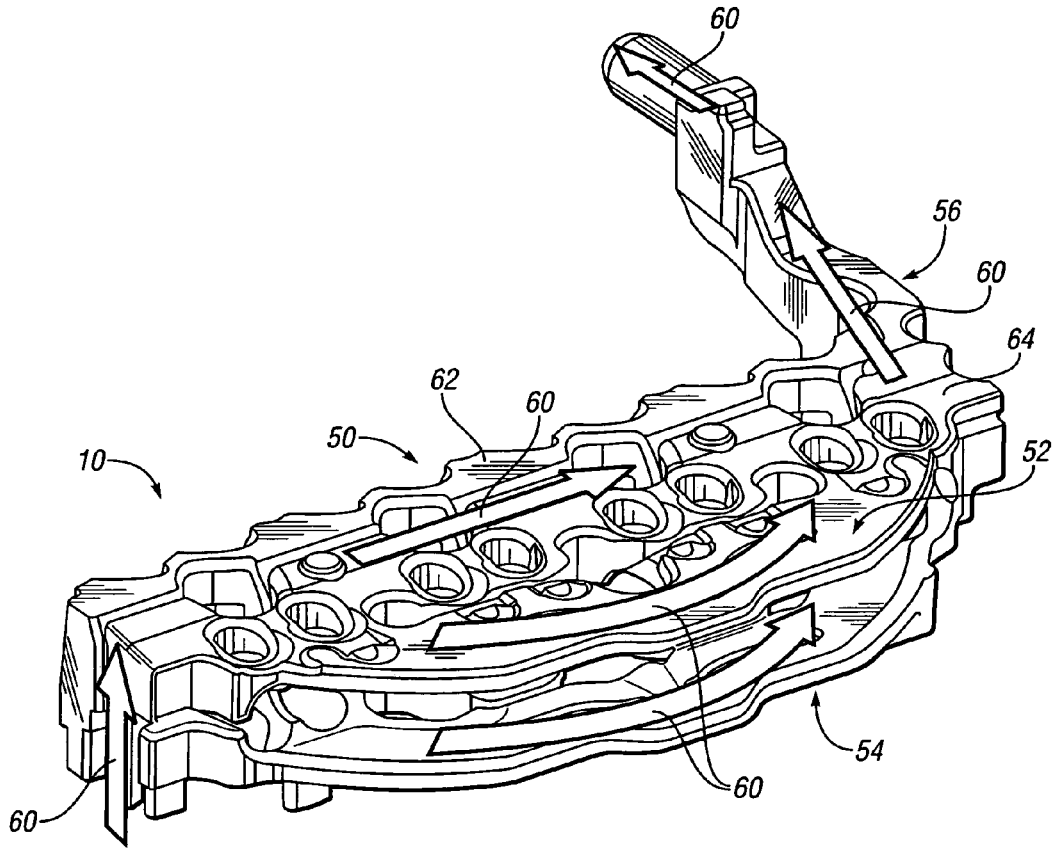
FIG. 5 is a perspective view of cooling jackets defined by the cylinder head shown in FIGS. 1 through 3, illustrating a parallel coolant flow pattern through the cylinder head for a two piece cooling jacket core design.

Referring now to FIG. 5, and with further reference to FIGS. 1 through 3, there is shown an alternate embodiment for the internal cooling jacket of the cylinder head casting 12 formed using a two piece cooling jacket core design. The cylinder head casting 12 defines the main cooling jacket 50. The main cooling jacket 50 is in fluid communication with the upper exhaust manifold cooling jacket 52 and the lower exhaust manifold cooling jacket 54. Additionally, the main cooling jacket 50, upper exhaust manifold cooling jacket 52, and lower exhaust manifold cooling jacket 54 is in fluid communication with the coolant outlet passage 56. For this embodiment, a first cooling jacket core member 62 forms at least a portion of the main cooling jacket 50 as well as the lower exhaust manifold cooling jacket 54 and the coolant outlet passage 56 during the casting of the cylinder head casting 12. Additionally, a second cooling jacket core member 64 forms at least a portion of the main cooling jacket 50 as well as the upper exhaust manifold cooling jacket 52 during the casting of the cylinder head casting 12.

Figure 6:
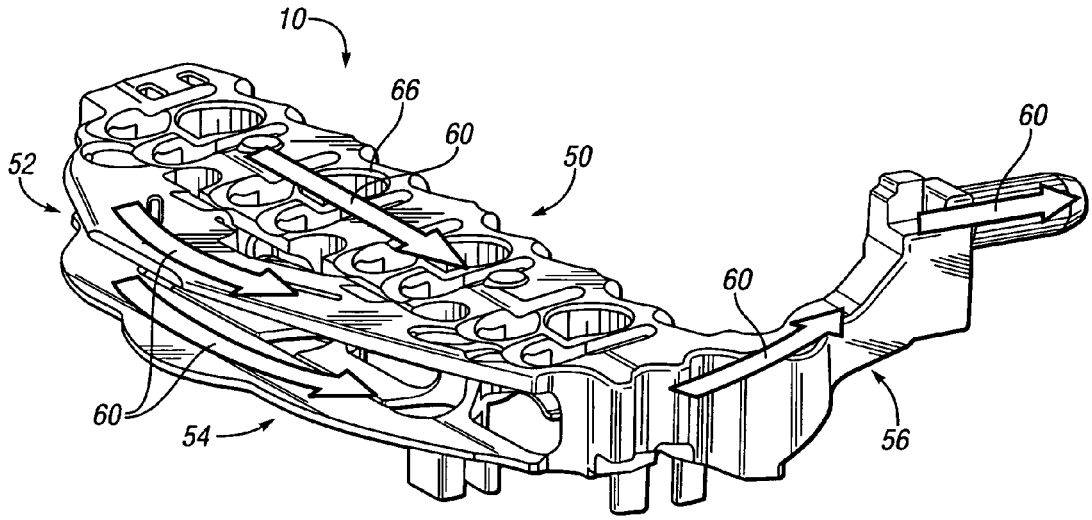
FIG. 6 is a perspective view of cooling jackets defined by the cylinder head shown in FIGS. 1 through 3, illustrating a parallel coolant flow pattern through the cylinder head for a one piece cooling jacket core design

With reference to FIG. 6, the first and second cooling jacket core members 62 and 64, shown in FIG. 5, are combined to form a cooling jacket core member 66. Internal cooling jackets of a similar configuration to those shown in FIG. 5 may be formed using this one piece cooling jacket core design. The cooling jacket core member 66 forms the main cooling jacket 50, the upper exhaust manifold cooling jacket 52, the lower exhaust manifold cooling jacket 54, and the coolant outlet passage 56 during the casting of the cylinder head casting 12.

Referring to both FIGS. 5 and 6, and with further reference to FIG. 1 through 3, in operation, the cylinder head 10 receives coolant 60, from the cylinder block, not shown. The bulk of this coolant 60 is directed toward the rear, or side opposite the integral cam drive case 18, of the cylinder head 10. The coolant 60 flows through the main cooling jacket 50, thereby extracting heat energy from the cylinder head 10 and, more specifically, in the general region of the combustion chambers 28. As the coolant 60 moves toward the front of the cylinder head, i.e. toward the integral cam drive case 18, the coolant 60 is introduced to the upper exhaust manifold cooling jacket 52 and the lower exhaust manifold cooling jacket where it extracts heat energy from the integral tuned exhaust manifold 22. Subsequently, the coolant 60 is introduced to the coolant outlet passage 56 where it traverses the cylinder head in a generally orthogonal orientation with respect to the main cooling jacket 50. The coolant 60 exits the cylinder head 10 through the coolant outlet fitting 58 where it is subsequently introduced to the cooling system of the vehicle. This type of coolant flow pattern is referred to as a parallel coolant flow pattern wherein the coolant 60 traverses the main cooling jacket 50 while the coolant 60 is simultaneously communicated to the upper exhaust manifold cooling jacket 52 and the lower exhaust manifold cooling jacket 54.

In summary, by directing or positioning the exhaust ports 36A and 36B and the exhaust runners 42 of an integral exhaust manifold toward the collector volume 40, increases in engine performance may be achieved. Additionally, less packaging space may be required since the size of the cylinder head 10 may be reduced. By providing both an upper exhaust manifold cooling jacket 52 and lower exhaust manifold cooling jacket 54, the reliability of the cylinder head 10 may be increased and underhood temperatures may be reduced.

While the best modes for carrying out the invention have been described in detail, those familiar with the art to which this invention relates will recognize various alternative designs and embodiments for practicing the invention within the scope of the appended claims.

The invention claimed is:

1. A cylinder head comprising:

a head casting defining a plurality of exhaust ports and an exhaust outlet;

a tuned exhaust manifold internally defined by said head casting;

wherein said tuned exhaust manifold includes a plurality of exhaust runners in communication with said plurality of exhaust ports;

wherein said tuned exhaust manifold includes a collector volume in communication with said plurality of exhaust runners and said exhaust outlet; and wherein each of said plurality of exhaust runners is substantially oriented or directed toward said collector volume to thereby define a straight path between each respective one of said plurality of exhaust ports and said exhaust outlet.

2. The cylinder head of claim 1, wherein said head casting defines a main cooling jacket operable to cool said head casting.

3. The cylinder head of claim 2, wherein said head casting defines an upper cooling jacket disposed in heat exchange relation to said tuned exhaust manifold.

4. The cylinder head of claim 3, wherein said head casting defines a lower cooling jacket disposed in heat exchange relation to said tuned exhaust manifold.

5. The cylinder head of claim 3, wherein said upper cooling jacket is in fluid communication with said main cooling jacket.

6. The cylinder head of claim 1, further comprising at least one spark plug tube formed integrally with said cylinder head casting.

7. The cylinder head of claim 1, further comprising a cam drive case formed integrally with said cylinder head casting.

8. The cylinder head of claim 1, wherein said cylinder head casting defines a cooling jacket, said cooling jacket has one of a series coolant flow pattern and a parallel coolant flow pattern.

9. A cylinder head comprising:

a head casting defining at least one combustion chamber in selective communication with a plurality of exhaust ports, and further defining an exhaust outlet;

a tuned exhaust manifold internally defined by said head casting;

wherein said tuned exhaust manifold includes a plurality of exhaust runners in communication with said plurality of exhaust ports;

wherein said tuned exhaust manifold includes a collector volume in communication with said plurality of exhaust runners and said exhaust outlet; and wherein each of said plurality of exhaust ports and each of said plurality of exhaust runners are substantially oriented or directed toward said collector volume to thereby define a straight path between each of said plurality of exhaust ports and said exhaust outlet.

10. The cylinder head of claim 1, wherein said head casting defines a main cooling jacket operable to cool said head casting and wherein said head casting defines an upper cooling jacket disposed in heat exchange relation to said tuned exhaust manifold and wherein said head casting defines a lower cooling jacket disposed in heat exchange relation to said tuned exhaust manifold.

11. The cylinder head of claim 9, further comprising at least one spark plug tube formed integrally with said cylinder head casting.

12. The cylinder head of claim 9, further comprising a cam drive case formed integrally with said cylinder head casting.

13. The cylinder head of claim 9, wherein said cylinder head casting defines a cooling jacket, said cooling jacket has one of a series coolant flow pattern and a parallel coolant flow pattern.

14. A cylinder head casting defining a plurality of exhaust ports, the cylinder head casting comprising:

a tuned exhaust manifold internally defined by said head casting;

a cooling jacket defined by the cylinder head casting, said cooling jacket having one of a series coolant flow pattern and a parallel coolant flow pattern;

wherein said tuned exhaust manifold includes a plurality of exhaust runners in communication with the plurality of exhaust ports;

wherein said tuned exhaust manifold includes a collector volume in communication with said plurality of exhaust runners; and wherein each of the plurality of exhaust ports and each of said plurality of exhaust runners are substantially oriented or directed toward said collector volume.

15. The cylinder head casting of claim 14, wherein the head casting defines a main cooling jacket operable to cool the head casting.

16. The cylinder head casting of claim 14, wherein the head casting defines an upper cooling jacket disposed in heat exchange relation to said tuned exhaust manifold.

17. The cylinder head casting of claim 14, wherein the head casting defines a lower cooling jacket disposed in heat exchange relation to said tuned exhaust manifold.

18. The cylinder head casting of claim 14, further comprising at least one spark plug tube formed integrally with the cylinder head casting.

19. The cylinder head casting of claim 14, further comprising a cam drive case formed integrally with the cylinder head casting.

20. The cylinder head casting of claim 14, wherein the cylinder head casting defines an exhaust outlet in communication with said collector volume, wherein each of said plurality of exhaust runners is substantially oriented to define a straight path between each respective one of said plurality of exhaust ports and said exhaust outlet.

* * * * *